United States Patent [19]

Lobo, Jr. et al.

[11] 4,278,209

[45] Jul. 14, 1981

[54] APPARATUS FOR RECONDITIONING BAGGED MATERIAL

[75] Inventors: Gustavo Lobo, Jr., Bay Hills; Charles G. Hallbert, Coral Springs, both of Fla.

[73] Assignee: Lobo-Kane, Inc., New York, N.Y.

[21] Appl. No.: 53,323

[22] Filed: Jun. 29, 1979

[51] Int. Cl.[3] ..... B02C 1/10

[52] U.S. Cl. ..... 241/30; 241/219; 241/266

[58] Field of Search ..... 241/30, 219, 201, 218, 241/266, 267; 53/121

[56] References Cited

U.S. PATENT DOCUMENTS 2,689,093 9/1954 Fox ..... 241/219

*Primary Examiner*—Mark Rosenbaum

*Attorney, Agent, or Firm*—Brumbaugh, Graves, Donohue & Raymond

[57] ABSTRACT

Apparatus for reconditioning bagged material comprises a frame and opposed spaced front and back breaker plates mounted on the frame. The front breaker plate is pivotally mounted on the frame along either the top or bottom edge and the back breaker plate is pivotally mounted on the frame along the opposite of the top and bottom edge. An eccentric arrangement engages the free edges of the breaker plates for moving the free edges of each breaker plate toward and away from the other breaker plate. A first pair of crushing plates and a second pair of crushing plates are selectively mountable on the apparatus by a detachable coupling means for mounting either the first pair or the second pair on the eccentric for supporting the crushing plates at opposed spaced locations generally at right angles to the breaker plates to define a rectangular receiving space for receiving the bags, and also for moving the crushing plates of the mounted pair in circular paths in opposite directions toward and away from each other.

9 Claims, 6 Drawing Figures

APPARATUS FOR RECONDITIONING BAGGED MATERIAL

BACKGROUND OF THE INVENTION

The present invention relates to improvements in reconditioning apparatus for bagged material.

Apparatus for breaking up hardened granular or powdered substances contained in a bag, without having first to remove the contents, are known. One such device has been constructed and used to break up sugar, which has hardened over time due to temperature and humidity, contained in commercial quantity 100 lb. paper bags. The bags are fed one-by-one through the machine between a pair of opposed breaker plates and a pair of side crusher plates, arranged generally at right angles to define a rectangular receiving space for the bags and which impart cyclical crushing forces to the bag to break up the hardened material.

In the aforementioned device, the front breaker plate is pivoted on the frame along its lower edge, and the back breaker plate is pivoted on the frame along its upper edge. A motor-driven eccentric drives the free ends of the breaker plates simultaneously back and forth toward and away from each other. At the same time, the eccentric moves the side crusher plates, which are welded onto arms attached to the eccentric, in a circular path toward and away from each other.

In operation, one end of a 100 lb. bag of sugar is inserted between the breaker plates and side crusher plates. The circular motion of the side crusher plates and the back and forth motion of the front and back breaker plates are phased such that the side plates move toward each other at the time that the front and back breaker plates move away from each other. Each time the side plates move together and capture the bag, the breaker plates move apart and release the bag, and the circular motion of the side plates move the bag through the machine (in incremental steps). As the bag moves through the apparatus, the breaker and crusher plates apply a crushing force, alternatively from the sides and from the front and back, to the portion of the bag between the plates, such that by the time the entire bag has moved through the apparatus, the hardened contents have been returned to a powdered or granulated form.

The device is disclosed generally in Fox U.S. Pat. No. 2,689,093, but differs from the described device inasmuch as the side plates, or crusher plates, have an inwardly extending convex surface which is forced into the sides of the 100 lb. bags to help break up the material. Also the pivoting end of the back breaker plate is attached to the frame by a pair of longitudinally extending threaded rods, which are received in cooperating holes fixed relative to the frame, rather than by a hydraulic piston and cylinder unit as shown in the Fox patent drawings.

In order to effect comminution of the sugar in the 100 lb. bags, the plates need to apply a substantial force to the bag sides, front and back, and the apparatus must be capable of applying such forces and withstanding the resultant stresses, which are aggravated by the fact the forces are applied cyclically, machine fatigue thus becoming a factor.

Since large forces are applied to the bags, however, breakage is a significant problem, and is reduced only by precise positioning of the breaker and crusher plates. To help reduce breakage, the spacing between the front and back breaker plates is somewhat adjustable. The pivot rod on the back breaker plate is connected at each end to a block, the blocks in turn being connected to a cross-supporting member arranged between upper and lower plates. The threaded rods used to couple the plate to the frame, are in turn welded to the cross-support. The plates have track supports at each end onto which the block are welded.

A cross member of the frame receives the threaded rods to secure the pivot support on the upper edge of the back breaker plate. The cross member has a pair of large holes, in which a support plate is positioned. Thereafter, the support plate is attached to the cross member, and engages the upper and lower plates to add support. The support plate has a pair of holes arranged to receive the threaded rods. A pair of nuts on each rod, positioned on each side of the hole, are used to adjust the positions of the rods, the cross-supporting member, and thereby the back breaker plate relative to the frame. This arrangement, however, permits only very limited longitudinal adjustability, since the upper and lower plates are constrained by the support plate. Moreover, under the cyclical stresses of machine operation, the blocks tend to loosen and disengage from the track.

The side arms, attached at one end to the side crusher plates, are adjustably attached at their other ends to the eccentric. The free end of each arm is bifurcated, and has a serrated lower surface which engages cooperating serrations on the eccentric. Each arm is attached to the eccentric by a nut and bolt arrangement. The bolt, attached to the eccentric, extends vertically between the tangs of the arm. With the nut loosened, the arm can be adjusted longitudinally to engage a different set of serrations. Once positioned, the nut tightens down over the tangs to secure the arm on the eccentric housing. In practice, however, it has been found that the retaining force exerted by the nuts and the constant machine vibration tend to separate the tangs, causing them to loosen or crack.

Although the supporting arms which carry the side crusher plates can be adjusted lengthwise on the eccentric, no adjustment of the spacing between the crusher plates, and thereby the widthwise adjustment of the bag receiving space, is possible. Commonly, however, granulated materials are packaged for retail in small paper bags, for example 5 lb. sugar bags, which are sold commercially in larger units, for example, in the case of sugar, twelve 5 lb. sugar bags arranged within a 60 lb. paper bundle. It was thought that a Fox type comminuting machine could not be used with respect to such types of double packaged materials. The cross-sectional dimensions of the bundles, dictated by the size and internal arrangement of the 5 lb. bags, tend to vary drastically from the single 100 lb. package commercial counterpart. Also, the inner 5 lb. bags provide internal cross support to the hardened sugar, and thus 12 discreet masses of material need to be crushed without breaking either the interior bags or the outer paper bundle. Moreover, the 60 lb. bundles contain two interior 5 lb. bags, surrounded on three sides by other 5 lb. bags, which, if fed through a Fox type machine, would experience no direct crushing blows from the side crusher plates.

Both for the reasons of non-adjustability and because, as described above, the sugar is double packaged (5 lb. bags within 60 lb. bundles), the Fox type machine was not considered adaptable to 60 lb. bundles of hardened sugar, and sugar packaged in such bundles has continued to be reconditioned by prior art methods of applying blows to the bundles by hand or removing the sugar from the 5 lb. bags, comminuting, and then repackaging, the loose sugar. Both methods are costly and wasteful, however, due to the high percentage of breakage loss in the former, and the expense of removing and repackaging in the latter.

SUMMARY OF THE INVENTION

The present invention is an improvement in the Fox apparatus as described above, and as generally shown in U.S. Pat. No. 2,689,093, for breaking up hardened sugar, or other granular or powdered substances, while contained in bags. In accordance with the present invention, a reconditioning apparatus may be used interchangeably to crush hardened materials in a variety of bag sizes and configurations, and may be used equally as well to recondition bundles containing smaller packages of bagged materials.

More particularly, the present invention comprises apparatus for reconditioning bagged material which includes a frame, opposed spaced front and back breaker plates mounted on the frame, and side crusher plates mounted generally at right angles to the breaker plates. In the preferred embodiment of the invention, the front breaker plate is pivotally mounted on the frame along its lower edge, and the back breaker plate is pivotally mounted to the frame along its upper edge. A motor driven eccentric engages the front and back breaker plates along their free edges (upper and lower edges, respectively) to drive the free edges of each plate toward and away from the other plate. Side crushing plates either of a first pair of crushing plates or a second pair of crushing plates, the pairs differing in size or configuration to be used for differing applications, are mounted on the apparatus. A detachable coupling arrangement rigidly mounts either the first pair or the second pair of side crusher plates on arms attached to the eccentric for supporting the plates at opposed spaced locations generally at right angles to the breaker plate, thereby to define a rectangular receiving space for inserting the bags. The eccentric moves the mounted pair of crushing plates in circular paths in opposite directions toward and away from each other in coordination with the back and forth movement of the breaker plates.

To mount the side crusher plates on the arms, preferably each has bosses which extend behind the plate perpendicular to the plate surface having two sets of aligned holes for receiving a pair pintles. The free end of each arm also has bosses extending therefrom, including cooperating holes for receiving the pintles. When attaching the plate to the arm, the pintles are inserted through aligned holes in the bosses on the plate and arm to rigidly mount the plate on the arm. The first and second pairs of side crusher plates are thus easily interchangeable, and thus the width of the bag receiving space may easily be adjusted for the specific machine application.

The front and back breaker plates are adjustable toward and away from each other for varying the length of the bag receiving space. As described in the Background of the Invention section, a cross support is pivotally attached to the back breaker plate along the upper edge, and the cross support is arranged between a pair of spaced plates. The movement of the pivot is constrained, however, by the support plate on the frame cross member. In accordance with the invention, the support plate, attached to the frame cross member, is repositioned to the outside of the frame to permit the upper and lower plates, and thereby the pivot support, to move longitudinally by adjusting the nuts on the threaded rods. The bottom edge of the back breaker plate, coupled to the eccentric, is also adjustable toward and away from the front breaker plate. Supporting spacers at the other ends of the plates secure the plates in spaced relation, prevent separation of the plates during machine operation, and retain the pivot supporting blocks in the tracks. Alternatively, the upper and lower plates may be fixed on the frame with the blocks slidably retained in the tracks to adjust the cross support and back breaker plate longitudinally.

As described above, the side arms for supporting the crusher plates, on the Fox machine, are mounted to the eccentric housings by a nut and bolt arrangement, in which the bolt extends through the bifurcated end of the arm, such that the arms are longitudinally adjustable. As opposed to the Fox device, however, in the present invention, a U-shaped clamp, having a hole to receive the bolt, is positioned over the arm to engage the tangs on either side, to absorb the clamping force of the nut and prevent separation or cracking of the arm.

In accordance with the present invention, the apparatus may be quickly and easily adapted to effectively recondition bagged materials of different cross-sectional dimensions and weight. Furthermore, apparatus according to the present invention effectively reconditions 60 lb. bundles of 5 lb. sugar bags, or the like, whose size and internal support structure vary drastically from single bagged materials, that is, singularly packaged granular or powder materials, but at the same time retains the adaptability to recondition the conventional 100 lb. bags.

For a better understanding of the invention, reference is made to the following detailed description of the preferred embodiment, taken in conjunction with the drawings accompanying the application.

DETAILED DESCRIPTION OF THE PREFERRED EMBODIMENT

Figures 1, 3, 4, 5, 6:
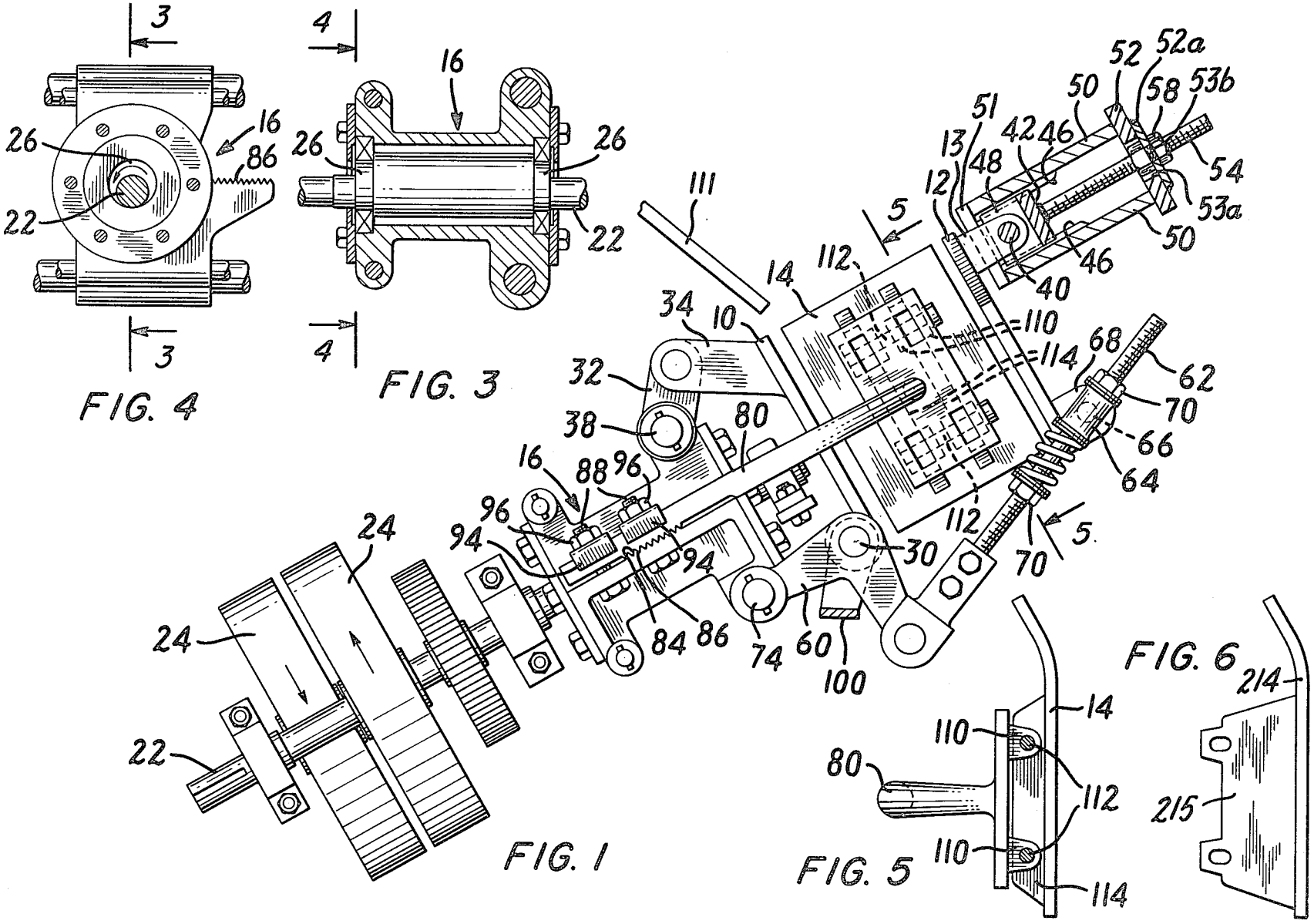
FIG. 1 is a side elevation, partially in section, of a reconditioning apparatus, with the frame omitted for clarity.
FIG. 3 is a longitudinal, sectional view through one of the eccentric housings, taken at lines 3—3 of FIG. 4.
FIG. 4 is a transverse sectional view of one of the eccentric housings taken at line 4—4 of FIG. 3.
FIG. 5 is a side view of one of a first pair of side crusher plates assembled on the end of a side arm.
FIG. 6 is a side view of one of a second pair of side crusher plates, unmounted.

Referring to the drawings, the apparatus illustrated is an improvement of the device illustrated in U.S. Pat. No. 2,689,093. A pair of breaker plates 10 and 12 and a pair of side crusher plates 14 are mounted as described below and are arranged generally at right angles to each other to define a rectangular bag receiving space 17. A pair of eccentrics 18 and 20 drive the breaker plates 10 and 12, as well as the side crusher plates 14, to vary the rectangular cross-sectional configuration of the receiving space 17 as a bag of hardened material moves through the apparatus. The plates 10, 12 and 14 apply a cyclical crushing force to the bag to break up the hardened contents, as described below.

A pair of parallel shafts 20 and 22, which also carry a pair of flywheels 24, are journaled in bearings mounted on the frame (not shown). One of the shafts 22 is driven by any suitable drive device, such as a motor-pulley arrangement.

Each of the shafts 21 and 22 is received and is rotatable in an eccentric 18 and 20, respectively, such that rotation of the shafts causes the eccentrics to move in a circular path in a plane perpendicular to the shaft rotational axis.

Referring to FIGS. 3 and 4, in which eccentric 16 is shown, the shaft 22 is arranged eccentrically in a disk 26, the disk 26 being received in cylindrical portions of the eccentric housing 16. Since the shaft 22 is fixed relative to the apparatus frame, rotation of the shaft 22 causes the housing 16 to move in a circular path in a plane perpendicular to the rotational axis of the shaft 22.

The front breaker plate 10 is pivotally attached along its lower edge, at pivot shaft 30, to a fixed portion 100 of the apparatus frame. The upper edge of the front breaker plate 10 is coupled to the eccentric housing 16 by bracket arms 34 and toggle arm 32.

Figure 2:
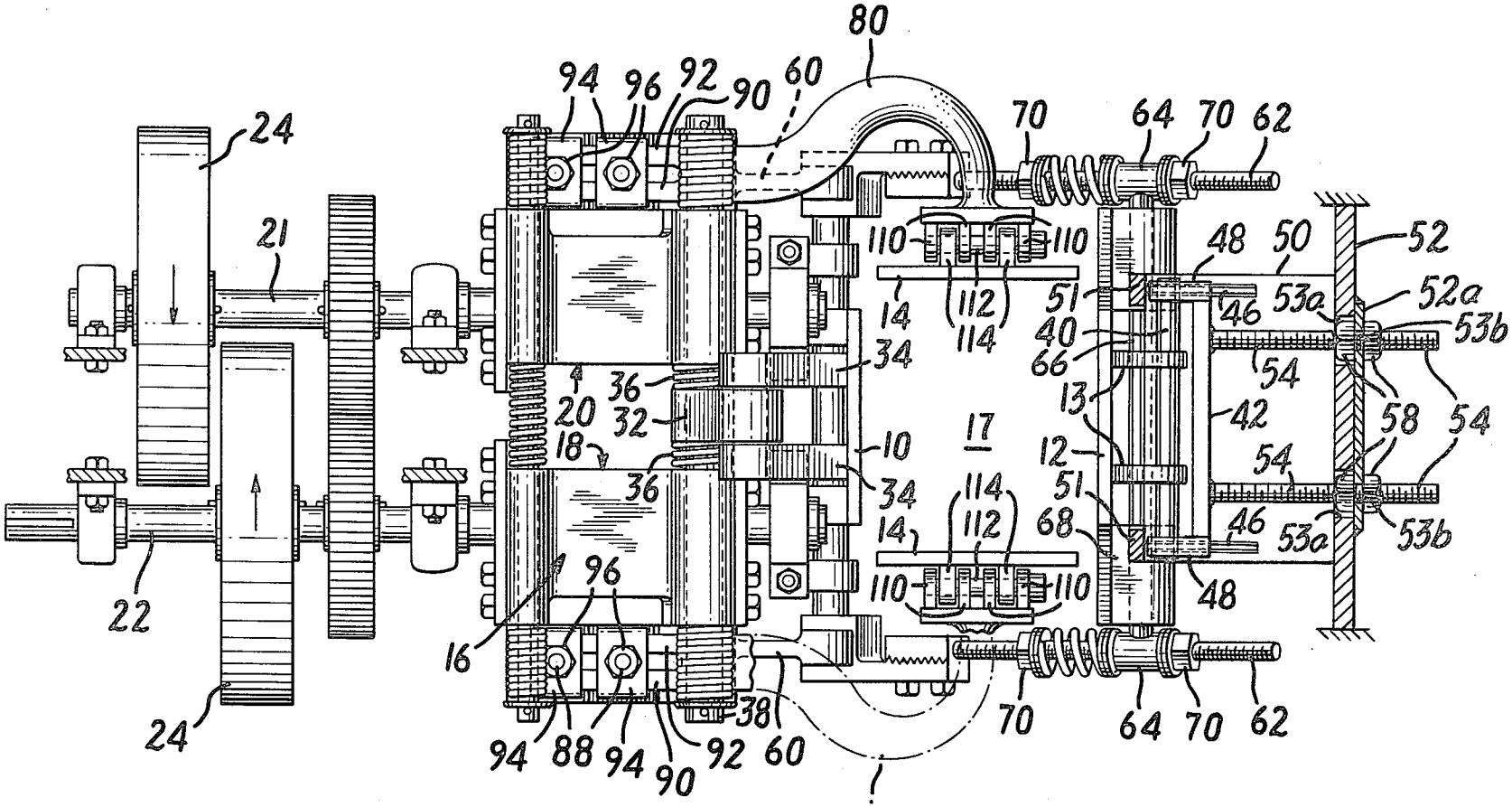
FIG. 2 is a top plan view, partially in section, of the apparatus shown in FIG. 1.

As shown more clearly in FIG. 2, the upper edge of the front breaker plate 10 is attached to the eccentric housing 16 such that only the up and down portion of the rotary movement of the eccentric housings 16 and 18 are imparted to the front breaker plate 10. The toggle arm 32 is slideably mounted on the guide rod 38 and positioned between two springs 36. Therefore, the back and forth (side-to-side) portion of the rotary motion of the eccentrics 16 and 18 is absorbed by springs 36, and not imparted to the plate 10. The up and down movement of the eccentric housings 18 and 20, however, is imparted directly to the toggle arm 32, and thereby to the upper edge of the front breaker plate 10 to move the upper edge of the plate 10 back and forth toward the back breaker plate 12.

The upper edge of the back breaker plate 12 is pivotally mounted relative to a fixed portion of the frame. The back breaker plate 12, however, is adjustable toward and away from the front breaker plate 10 to adjust the width of the receiving space 17 for the bags. Accordingly, a pivot shaft 40 extends through aligned holes in bearing brackets 13 on the upper edge of the breaker plate 12 and is received at each end in a pair of blocks 48. The blocks 48, in turn, are attached to a cross support 42. The cross support 42 is arranged between a pair of spaced apart plates 50, which have track portions 46 which receive and hold the blocks 48. In the embodiment shown, the blocks 48 are slideably arranged on the track 46, and each of the plates 50 is mounted on a fixed frame cross member 52. A pair of spacers 51, welded to the free ends of the plates 50, maintain the plates in fixed spacial relation and hold the sliding cross support 42 therebetween.

The position of the sliding cross support 42 is fixed by a pair of threaded rods 54 attached at one end to the cross support 42. The frame cross member 52 has a pair of large holes **53*a* over which a support plate 52*a* is positioned and thereafter attached to the member 52. The support plate 52*a*, in turn, has a pair of holes 53*b* through which the threaded rods 54 extend. A pair of nuts 58 on either side of each supporting plate hole 53*b* adjust the position of the rod 54, to fix the position of the back breaker plate 12** at a selected location relative to the frame.

Alternatively, the blocks 48 may remain welded to the plates 50 as in the Fox machine, in which case the plates are not welded to the frame cross member 52. By relocating the support plate **52*a* on the outside of the frame member 52, as is shown in the drawings, the upper and lower plates 50 are spaced apart from the frame cross member 52, and the entire assembly of the plates 50, blocks 48, cross support 42, pivot 40, and thereby the back breaker plate 12, is free to be adjusted longitudinally thereby to adjust the spacing between the front 10 and back 12** breaker plates.

The bottom edge of the back breaker plate 12 is coupled to the eccentric. A pair of bell cranks 60, each attached at one end to the eccentric housing 20 or 18, pivot around fixed pivot point 30, and at other end are attached to threaded rods 62. A sleeve 64 on the rod 62 supports another pivot shaft 66, which extends through a pair of support arms 68 on the bottom edge of the back breaker plate 12.

The support sleeves 64 on the threaded rods 62 are slidable along the rod, to adjust the height of the bag receiving space 17 when the upper edge of the back breaker plate 12 is adjusted. In the arrangement shown, the sleeve 64 is positioned between a pair of adjusting nuts 70, which are used to adjust the position of the sleeve 64, and thereby the bottom edge of the breaker plate 12.

Although not shown in the drawings, the bell crank 60 is slidably mounted on the cross support rod 74 in a manner similar to the slidable mounting of the rod 32 on the guide rod 38, thereby to transmit only the up and down, and not the side-to-side, portions of the eccentric housing motion through the fixed pivot 30.

In addition to moving the upper edge of the front breaker plate 10 and the lower edge of the back breaker plate 12 toward and away from each other, the eccentric also drives the pair of side crusher plates 14. A pair of arms 80 support the side crusher plates 14 in a manner described below. One end of each of the arms 80 is attached to the eccentric 18 or 20. The end of the arms 80 attached to the eccentric has a serrated lower edge 84 to engage a cooperating serrated edge 86 on the eccentric housings 18 and 20. The ends of the arms 80 are bifurcated, and a pair of bolts 88 attached to each of the eccentrics 18 and 20 extend between the tangs 90 and 92 of the bifurcated ends of the arms 80. A U-shaped clamp 94 has a central hole for receiving the bolts 88, and the side legs of the clamp 94 fit over the tangs 90, 92 and engage the outer sides of the tangs 90, 92. Each arm 80 and clamp 94 assembly is secured to the eccentric 18 or 20 by a nut 96 screwed down on the bolt 88. With such an arrangement, the arms 80 are adjustable lengthwise to a desired position. By loosening the nuts 96, the arm may be moved relative to the eccentric housing 20 or 18 to the desired position, with the bolts 88 sliding between the tangs 90 and 92 of the arms 80. Thereafter, once in position, the nuts 96 are re-tightened, and the arms are held secured. Moreover, the depending sides of the U-shaped clamp 94 prevent the tangs 90, 92 of the arms 80 from separating from the downward clamping force of the nuts 88, and likewise act to reinforce the arm 80 against the machine force stresses applied under load operating conditions.

The other end of each of the arms 80 carries the side crusher plates 14. The arms 80 have bosses 110 which extend in the direction of the bag receiving space. The bosses 110 on each arm 80 have two series of aligned holes for receiving a pair of pintles 112.

Likewise, the side crusher plates 14 have cooperating bosses 114 which extend behind the plates 14 perpendicular to the plate surface. The bosses 114 are received between the bosses 110 on the arms 80, and also have aligned holes for receiving the pintles 112.

In operation, a bag of hardened material is inserted down the chute 111 into the rectangular receiving space 16. Once received in the space 16, the front and back breaker plates 10 and 12 and the side crusher plates 14 alternatively capture the bag to crush a portion of the bag to break up the contents. As the side crusher plates 14 move apart, the eccentric moves the top and bottom edges of the front 10 and back 12 breaker plates, respectively, toward each other to capture the bag. As the front and back breaker plates 10 and 12 crush the bag, the side crusher plates 14 move away from the bag and move freely in a circular motion around to engage the bag at a slightly higher position. As the crusher plates 14 again capture the sides of the bag, simultaneously the breaker plates 10 and 12 move apart and release the bag. The crusher plates 14 move together in a downward circular motion both to crush the contents and to move the bag downward through the receiving space 16 in an incremental motion.

The bag receiving space is preferably adjusted to correspond to the cross section of the bag being crushed. Thus, in addition to adjusting the spacing between the front and back breaker plates 10 and 12 as described above, it may be desired to interchange side crusher plates to varying the width of the bag receiving space 16. It may also be desired to use plates having different shapes (flat, concave, or convex, for example) or widths for different applications to crush more effectively and with less breakage. The side crusher plates 14 may thus easily be interchanged with a second set of side crusher plates 214 (one of which is illustrated in FIG. 6), for example when switching between 100 lb. bags of sugar (plates 14) and 60 lb. bundles (plates 214). By merely sliding out the pintle 112, the side crusher plates 14 readily separate from the supporting arms 80, without the need for further disassembly of the apparatus. Thereafter, the second set of crusher plates 214 is positioned to align the holes in the bosses 215 with the cooperating holes in the bosses on the arms 80, and the pintle is reinserted. In addition to providing readily interchangeable side crusher plates, affording an adaptability to the machine not heretofore present, the mounting of the side crusher plates is secure and able to transmit the high stresses and forces required to break up the hardened materials. Together with the adjustability of the back breaker plate, the interchangeability of side crusher plates provides a unique capability to handle a wide variety of diverse applications, and the machine can switch to an alternate operating mode quickly and easily, with a minimum of down time.

In the preferred applications described above, the apparatus is adjusted to accept either 100 lb. sugar bags or 60 lb. bundles of 5 lb. sugar bags. In switching from the 100 lb. bags, the side plates 214 replace the plates 14 to reduce the width of the bag receiving space 16 by 4 inches. The back breaker plate 12 is also adjusted to increase the height of the bag receiving space 16 from 7¾ inches to 10 inches, and the plate 214 also provides a wider face to engage the wider sides of the 60 lb. bundles.

In accordance with the present invention, the high stresses and working forces needed to comminute the hardened material contained in the bags is applied under exacting conditions to maintain bag breakage at a minimum. In test to date, breakage of the 60 lb. bundles of 5 lb. sugar bags has been maintained at approximately 2%. Moreover, the machine has exhibited high durability, in spite of the adjustability of the breaker plates and the detachable coupling arrangement for the side crusher plates.

The invention has been shown and described with reference to certain preferred embodiment thereof. Modifications and variations of the disclosed embodiment will be apparent to those in the art. For example, while the invention has been described with reference to two sets of side crusher plates, evidentally any number of interchangeable crusher plates of various sizes or with variable plate configurations may be provided in accordance with the specific application. Although the breaker plates 10 and 20 are shown for clarity as singular, fixed plates, the breaker plates 10 and 12 may also be attached to mounting plates in a pintle arrangement similar to the side crusher plates. All such modifications and variations are intended to be within the scope of the present invention, as defined in the following claims.

We claim:

1. In an apparatus for reconditioning bagged material comprising opposed spaced front and back breaker plates, opposed spaced crusher plates arranged generally at right angles to said breaker plates to define a rectangular space for receiving bagged material, and eccentric means for cyclically moving said breaker plates toward and away from each other and synchronously moving said crusher plates toward and away from each other, wherein said crusher plates move away from each other as said breaker plates move toward each other, the improvement wherein said crusher plates comprise one of a first pair of crusher plates and a second pair of crusher plates, and coupling means between said eccentric means and said crusher plates for rigidly coupling a selected one of said first pair and said second pair to said eccentric means, and means for detachably mounting a selected one of said first and second pairs to said coupling means for rigidly coupling said pair to said eccentric means for moving the crusher plates toward and away from each other, generally at right angles to said breaker plates to define a space for receiving the bags, wherein said selected one of said first and second pairs define a space for receiving bagged material of pre-selected cross sectional area maintained substantially constant during bag-crushing movement of the plates.

2. The improvement according to claim 1, comprising a pair of arms, each said arm attached at one end to said eccentric means for supporting one of said one pair of crusher plates at the other end.

3. In an apparatus for reconditioning bagged material including a frame, opposed spaced front and back breaker plates having top and bottom edges, means for pivotally supporting said front breaker plate on said frame along one of said top and bottom edges, means for pivotally supporting said back breaker plate on said frame along the opposite of said top and bottom edges, eccentric means engaging each said breaker plate at the non-pivotally supported, free edge for moving the free edge of each breaker plate toward and away from the other breaker plate, opposed spaced crusher plates arranged generally at right angles to said breaker plates to define a rectangular receiving space for receiving bagged material, and means for coupling each of said crusher plates to said eccentric means comprising a support arm rigidly connected at one end with said eccentric means and supporting a crusher plate at its other end, wherein said eccentric means and said support arms are arranged to move said crusher plates in circular paths in opposite directions towards and away from each other, the improvement wherein said crusher plates comprise one of a first pair of crusher plates and a second pair of crusher plates, and comprising detachable coupling means for rigidly mounting a selected one of said first pair and said second pair on said supporting arms for supporting said one pair at opposed spaced locations generally at right angles to said breaker plates to define a rectangular receiving space of selected cross-sectional area for receiving the bags maintained substantially constant during bag-crushing movement of the plates.

4. The improvement according to claim 1 or 3, wherein said coupling means comprises pintle means.

5. The improvement according to claim 2 or 3, wherein said coupling means comprises pintle means, wherein the other end of each arm has a plurality of bosses with holes for receiving one or more pintles, and wherein said crusher plates have bosses with cooperating holes therein for receiving said pintles.

6. The improvement according to claim 1 or 3, comprising means for adjusting the spacing between said front and back breaker plates for varying the height of the bag receiving space for receiving bags of substantially different cross sectional height.

7. The improvement according to claim 3, comprising means for adjusting the spacing between said front and back breaker plates for varying the height of the bag receiving space for receiving bags of substantially different cross sectional height, wherein said pivotal supporting means on said back breaker plate comprises slide means, guide means supported on said frame for receiving said slide means for moving said back plate toward and away from said front plate, an adjustment member having one end ridigly attached to said slide means, and means on said frame for selectively engaging said adjustment member at a selected location on said member spaced from said one end.

8. The improvement according to claim 2 or 3 wherein said one end of said arm is bifurcated, said bifurcated ends having serrated engagement surfaces, wherein said eccentric means has cooperating serrated surfaces for engaging said arms and wherein each said arm is attached to said eccentric means by a bolt attached to said eccentric means and positioned to extend between the tangs of said bifurcated end, a U-shaped clamp having a hole therethrough for receiving said bolt, the sides of said U-shaped clamp being adapted to engage said bifurcated end on either side thereof, and a nut on said bolt for clamping said U-shaped member and said arm to said eccentric at a selected position.

9. A method for comminuting bundles, having one or more bags of a powdered or granular substance tightly arranged in said bundles, in an apparatus having a pair of opposed front and back breaker plates and a pair of spaced side crusher plates arranged substantially at right angles to said breaker plates to define a bundle-receiving space, comprising measuring the height and width of said bundles in cross-section perpendicular to the longitudinal axis of said bundles, adjusting the spacing between said breaker plates to correspond approximately to the height of said bundles, adjusting the spacing between said crusher plates to correspond approximately to the width of said bundles to provide a cross-sectional area in said bundle-receiving space approximately corresponding to the cross-sectional area of said bundle, inserting one end of a bundle longitudinally into said bundle-receiving space, moving said plates toward and away from each other to alternatively crush said bundle from the front and back and the sides, while maintaining the instantaneous cross-sectional area between said plates approximately constant, and feeding said bag through said bundle-receiving space.

* * * * *